US005799527A

United States Patent [19]

Kenmochi et al.

[11] Patent Number: 5,799,527

[45] Date of Patent: Sep. 1, 1998

[54] METHOD OF PRODUCING A STAINLESS STEEL SHEET HAVING EXCELLENT SURFACE BRIGHTNESS

[75] Inventors: Kazuhito Kenmochi; Osamu Sonobe; Eisuke Kawazumi; Yoshikazu Seino; Takashi Akazawa; Kazusito Okada, all of Chiba, Japan

[73] Assignee: Kawasaki Steel Corporation, Kobe, Japan

[21] Appl. No.: 505,949

[22] Filed: Jul. 24, 1995

[30] Foreign Application Priority Data

Jul. 27, 1994 [JP] Japan ..... 6-193770

[51] Int. Cl.[6] ..... B21B 39/20

[52] U.S. Cl. ..... 72/252.5; 72/366.2; 72/199

[58] Field of Search ..... 72/234, 236, 252.5, 72/365.2, 366.2, 199; 492/3, 28

[56] References Cited

U.S. PATENT DOCUMENTS

| | | | |
|---|---|---|---|
| 4,599,883 | 7/1986 | Ginzburg et al. | 72/234 |
| 4,697,320 | 10/1987 | Ishihara et al. | 492/3 |
| 5,025,547 | 6/1991 | Sheu et al. | 72/199 |

FOREIGN PATENT DOCUMENTS

| | | |
|---|---|---|
| 0 292 313 | 11/1988 | European Pat. Off. . |
| 0 375 384 | 6/1990 | European Pat. Off. . |
| 0 387 361 | 9/1990 | European Pat. Off. . |
| 0 387 785 | 9/1990 | European Pat. Off. . |
| A-57-13362 | 1/1982 | Japan . |
| A-59-38344 | 3/1984 | Japan . |
| A-59-107030 | 6/1984 | Japan . |
| A-60-261609 | 12/1985 | Japan . |
| A-61-23720 | 2/1986 | Japan . |
| A-61-49701 | 3/1986 | Japan . |
| A-5-57304 | 3/1993 | Japan . |
| A-5-123704 | 5/1993 | Japan . |

*Primary Examiner*—Lowell A. Larson
*Assistant Examiner*—Ed Tolan
*Attorney, Agent, or Firm*—Oliff & Berridge

[57] ABSTRACT

A method of producing a stainless steel produces steel sheets having excellent surface brightness. The method includes performing a cold rolling operation using a work roll having a Young's modulus between 25,000 to 70,000 kg/mm$^2$ in one or more stands of a tandem mill having a plurality of stands. Preferably the work roll is composed of a tungsten carbide based hard metal alloy. The diameter of a work roll at a final stand of the tandem mill is equal to or smaller than a diameter of a work roll in the previous stand. It is preferable that the work roll is dimensioned to have a diameter between 150 mm to 400 mm. In addition, it is preferable that a cold rolling operation is achieved at a reduction between 25% to 60% reduction in the final stand of the tandem mill.

16 Claims, No Drawings

METHOD OF PRODUCING A STAINLESS STEEL SHEET HAVING EXCELLENT SURFACE BRIGHTNESS

BACKGROUND OF THE INVENTION

1. Field of the Invention

The present invention relates to a method of producing a stainless steel sheet having excellent surface brightness.

2. Discussion of Related Art

Conventionally, when a stainless steel sheet is cold-rolled, a Sendzimir mill including a work roll having a diameter of 100 mm or less was used. As disclosed in Japanese Patent Publication No. 57-13362, the Sendzimir mill is used because it is necessary to roll the stainless steel sheet under conditions of a high reduction and a high tensile strength, since stainless steel has a high resistance against deformation, and moreover, remarkable work hardening is recognized with the stainless steel.

However, when the Sendzimir mill is used, reverse milling increases the rolling time. Furthermore, when stainless steel sheets are rolled under a high reduction, a large roll-down force is exerted on the mill and a breakdown of an oil film is liable to occur when a rolling oil is fed between the work roll having a small diameter and the steel sheet.

When mineral oil is fed to the mill to ensure that the surfaces of the steel sheets exhibit excellent brightness after completion of rolling, the cooling ability of the roll and the steel sheet are reduced causing the breakdown of the oil film to readily occur. The breakdown of the oil film causes heat streaks on the steel sheet. Heat streaks are surface defect that remarkably reduce a yield of the sheet. To prevent heat streaks, the rolling speed is reduced. Consequently, the rolling of stainless steel sheets using the Sendzimir mill has a very low production efficiency.

In recent years, a method of rolling a stainless steel sheet with the aid of a tandem mill including a plurality of roll stands has been practiced to improve productivity of the stainless steel sheet. For example, Japanese Patent Laid-Open Publication Nos. 59-38344 and 59-107030 disclose a method of rolling a stainless steel sheet with the use of a work roll having a diameter of 150 mm or more. When stainless steel is rolled in a tandem mill, unidirectional rolling reduces the rolling time. Furthermore, the use of a larger diameter work roll and a rolling oil emulsion having a high cooling ability permit a large quantity of rolling oil to be located between the work roll and the stainless steel sheet. This arrangement produces no heat streak on the stainless steel sheet. As a result, a rolling operation can be performed at a high speed. Thus, the productivity of this method is improved when compared with productivity of the Sendzimir mill. Because a large quantity of rolling oil is located between the work roll and the sheet, it is difficult for the work roll to come in contact with the stainless sheet. As a result, the surface roughness of the stainless steel after completion of rolling operation is remarkably inferior in brightness when compared to the Sendzimir mill.

The use of a ferrite based stainless steel such as, for example, SUS430 often requires that the surface of the stainless steel sheet after completion of a finish skin pass rolling operation exhibit excellent brightness. Similarly, the use of an austenite based stainless steel, such as, for example, SUS 304 often requires that the stainless steel sheet be subject to a buff polishing operation after completion of finish adjust rolling. For this reason, it is important that the surface of the stainless steel after completion of the buff polishing operation exhibits excellent brightness.

As a method of improving surface brightness of the stainless steel sheet, a method of using a work roll coated with ceramic material having a small diameter similar to a work roll in the Sendzimir mill and performing a rolling operation using rolling oil having a low viscosity is disclosed in Japanese Patent Laid-Open Publication No. 60-261609. This method is intended to improve surface brightness of the stainless steel sheet and prevent the occurrence of heat streaking. And in order to meet the objectives, this method uses a work roll having a small diameter for e.g., the Sendzimir mill and a rolling oil having a low viscosity. However, this method improves the surface brightness by using a work roll having a small diameter for e.g., the Sendzimir mill. This method is not suited for a tandem mill and is problematic from the viewpoint of productivity.

To improve surface brightness of the stainless steel sheet by using a tandem mill, a method of cold-rolling a stainless sheet, thereafter, annealing and picking the stainless steel sheet, and subsequently, cold-rolling the stainless steel again is disclosed in Japanese Patent Laid-Open Publication No. 61-23720. A method of rolling a stainless steel with a work roll having a large diameter, and thereafter, rolling the same with a work roll having a small diameter is disclosed in Japanese Patent Laid-Open Publication No. 61-49701. These methods, however, require additional intermediate steps of annealing and pickling, and moreover, the work roll having a small diameter is used for rolling the stainless sheet. These methods suffer from reduced production efficiency.

A method of permitting work rolls each having a large diameter to crosswise extend under specific conditions is disclosed in Japanese Patent Laid-Open Publication No. 5-57304 and Japanese Patent Laid-Open Publication No. 5-123704. However, this method suffers from increased installation costs.

SUMMARY OF THE INVENTION

An object of the present invention is to overcome the above problems by providing a method of producing a stainless steel having excellent surface brightness using a tandem mill.

According to one aspect of the present invention, a method of producing a stainless sheet having excellent brightness is disclosed wherein a cold rolling operation is performed using a work roll having a Young's modulus of 25,000 to 70,000 kg/mm$^2$ in one or more stands in a tandem mill including a plurality of stands.

According to other aspects of the present invention, a method of producing a stainless sheet having excellent surface brightness is disclosed, wherein a cold rolling operation is performed using a work roll having a Young's modulus of 25,000 to 70,000 kg/mm$^2$ in one or more stands in a tandem mill including a plurality of stands after a preliminary treatment rolling operation is performed with a reduction of 5% to 30% or less while the surface of the work roll is coated without any lubricant or with a fluid lubricant by a thickness of 1 μm or less.

DETAILED DESCRIPTION OF PREFERRED EMBODIMENTS

Numerous factors have been found to harm surface brightness of cold rolled stainless sheets. The surface roughness on the stainless steel sheet after completion of the cold rolling operation is a result of a large surface roughness of the stainless steel caused by annealing and pickling of a hot rolled sheet performed before cold rolling that remains without sufficient flattening by cold rolling. The surface roughness of the stainless steel sheet directly after the hot rolled sheet is annealed and pickled or just pickled is very large. Specifically, an average surface roughness Ra is between 2 to 4 μm. This is produced by mechanical descaling processing such as shot blasting or the like after pickling by dipping in sulfuric acid. When a stainless steel sheet is cold-rolled, a large quantity of rolling oil is fed to the roll and steel sheet on an inlet side of the mill. This is intended to prevent heat streaking or the like by simultaneously performing lubricating and cooling the roll and sheet to produce a stable steel sheet. However, the rolling oil adheres to the surface of the roll and the steel sheet on the inlet side of the cold rolling mill with a thickness of several μm or more.

When the steel sheet having a large surface roughness is rolled in the cold rolling mill held in the foregoing state, the rolling oil deposits in the large concavities on the surface of the steel sheet. The rolling oil held in the concavities can not move when the roll contacts the steel sheet. As a result, the sheet is rolled while oil is enveloped in the concavities. The concavities containing the rolling oil are not greatly compressed during the rolling operation. As a result, a large portion of the concavities filled with oil remain after completion of the rolling. This effect produces a surface roughness for the steel sheet after cold rolling that is similar to the surface roughness before cold rolling. This greatly reduces the surface brightness of the steel sheets.

To obtain a steel sheet having excellent surface brightness, it is important that these concavities in the steel sheet be reduced in size during the cold rolling operation. Namely, the concavities in the surface of the steel sheet before the cold rolling can sufficiently be reduced in size by allowing convexities on the surface roughness cold rolling to come in contact with the surface of the steel sheet.

With respect to a cold rolling tandem mill having a large diameter work roll, since the roll diameter is large as compared to a conventional work roll, rolling oil interposes between the roll and the steel sheet. This effect prevents convexities on the surface of the roll from contacting the surface of the steel sheet.

In view of the above mentioned factors, it is an object of the present invention to provide a method of producing a stainless steel sheet having excellent brightness that ensures that the rolling oil is not taken in between the roll and the steel sheet, and a sufficient intensity of pressure is generated between the roll and the steel sheet.

A factor causing the rolling oil to be drawn between the roll and the steel sheet is a hydrodynamic force acting on the rolling oil. It has been found that a biting angle at a roll bit inlet has a substantial effect on the hydrodynamic force. When the biting angle is increased, the rolling oil is not drawn between the roll and the sheet.

Conventionally, a roll made of cast steel, forged steel or the like has a Young's modulus of 18,000 to 22,000 kg/mm$^2$. While the Young's modulus remains within the foregoing range, the biting angle relative to the roll hardly changed. For this reason, little attention has been paid in the past to the variation of Young's modulus for the purpose of improving the surface brightness of the stainless steel sheet.

In the present invention, as the Young's modulus of a work roll is increased, the biting angle can also be enlarged. This greatly reduces the amount of rolling oil drawn between the sheet and the roll. Additionally, when the Young's modulus of the roll is increased, the pressure between the roll and the steel sheet increases. This ensures that a sufficient pressure is generated between the roll and the steel sheet to remove concavities in the steel sheet. Excellent surface brightness is achieved when the Young's modulus is within the range of 25,000 to 70,000 kg/mm$^2$.

When the Young's modulus is less than 25,000 kg/mm$^2$, the biting angle at the roll bite inlet becomes small, and a large quantity of rolling oil is drawn between the roll and the sheet in the same manner as a steel alloy based roll used in the conventional tandem mill, resulting in the surface brightness of the steel sheet being degraded. Alternatively, when Young's modulus exceeds 70,000 kg/mm$^2$, the roll becomes excessively hard. This reduces the grinding operation.

The Young's modulus of a roll represents a Young's modulus of the roll where the roll contacts the steel sheet. For example, with respect to a composite roll, the Young's modulus of the roll represents the Young's modulus at an outer peripheral portion thereof.

It is desirable to enlarge the Young's modulus as far as possible within the range where the Young's modulus is not in excess of 70,000 kg/mm$^2$. A roll made of tungsten carbide based hard metal alloy (hereinafter referred to as WC based hard metal alloy roll) is suitable for this purpose. It is sufficient that the WC hard metal alloy is composed of WC of 50 to 99 wt %, Co of 0 to 30 wt % and Ni of 0 to 30 wt %. The WC based hard metal alloy roll may be used for all stands of a cold tandem mill. When an effect of improving brightness and cost are taken into account, the WC based hard metal alloy roll may be used for applying to a first stand and/or a final stand. When the WC based hard metal alloy roll is used in the first stand, concavities on the surface of a cold rolled steel sheet are sufficiently reduced. This improves the surface brightness. When the WC based hard metal alloy roll is in the final stand, the remaining concavities on the surface of the cold rolled steel sheet can be sufficiently reduced. This improves the surface brightness.

When the WC based hard metal alloy roll is used in a work roll having a small diameter, the biting angle between the roll and the steel sheet is originally large because of the small diameter of the work roll. There is little change in the quantity of rolling oil drawn between the sheet steel and an ordinary steel alloy based roll (5% Cr forged steel, cold working die, high speed steel or the like) or the WC based hard metal alloy roll. With this arrangement, it is difficult to reduce the film thickness of the rolling oil interposing between the roll and the steel sheet. Moreover, the effect of reducing roughness on the surface of a cold rolled steel sheet is substantially the same for the WC based hard metal alloy roll as well as the conventional ordinary steel alloy based roll.

However, when a large diameter work roll is used, the biting angle between the roll and the steel sheet is small and the influence on the quantity of intake of the rolling oil induced by variation of the Young's modulus of the roll is remarkably large. Variation of the Young's modulus with this arrangement permits the reduction of the film thickness of the rolling oil interposed between the roll and the steel sheet.

The work roll composed of the WC based hard metal alloy may be an integral roll fully composed of WC based hard metal alloy. However, since the latter is expensive, only a roll barrel portion may be composed of the WC based hard metal alloy and a roll neck portion is composed of a conventional steel alloy. Alternatively, a surface layer of the roll barrel portion may also be composed of WC based hard metal alloy. Furthermore, it is acceptable to fit the WC based hard metal alloy onto a steel alloy or metallize the WC based hard metal alloy on the steel alloy. To assure that Young's modulus is measured, it is desirable that thickness of the WC based hard metal alloy is set to 5 mm or more.

As described above, the hydrodynamic force acting on the rolling oil is a factor in drawing the rolling oil between the roll and the steel sheet. This force largely varies depending on rolling conditions. Various rolling conditions have been reviewed.

Based on the review, the diameter of a work roll at the final stand of the tandem mill is dimensioned to be equal or less than a diameter of a work roll of a previous stand. The diameter of the work roll should be within 150 mm to 400 mm. It is preferable from the viewpoint of strength of the roll that the diameter of the roll be set to 150 mm or more. To ensure that the quantity of rolling oil drawn between the roll and the steel sheet is reduced and the surface brightness of the steel sheet is improved, it is preferable that the diameter of the work roll be 400 mm or less.

In addition, to ensure that convexities on the surface of the roll sufficiently contact the surface of the steel sheet to improve the surface brightness of the steel sheet, it is effective that a reduction or percent reduction in thickness of the sheet at the time of cold rolling is increased. Specifically, since the brightness of a product of steel sheet is largely dependent on the surface of the steel sheet on an outlet side of the final stand in the tandem mill, it is necessary that the concavities on the surface of the steel sheet that exist after the previous stand be sufficiently reduced at the final stand. In view of the foregoing fact, when rolling is performed with the use of the WC based hard metal alloy roll while a reduction at the final stand is variously changed, the brightness is further improved when the reduction at the final stand is set to 25% or more. Furthermore, the reduction is preferably set to a value in excess of 40%. It is desirable from the viewpoint of the strength of the roll that the upper limit of the reduction be set to 60% or less.

When rolling is performed with the sheet having large roughness at the second stand and subsequent stands of the tandem mill, the rolling oil is not drawn between the roll and the steel band. The surface roughness of the object remains after completion of the cold rolling. The results in steel sheet having a reduced surface brightness.

The roughness of the work roll may be variously changed at each stand. After cold rolling, the surface brightness of each finished steel sheet is examined. It has been found that the brightness of the steel sheet is improved by successively reducing the roll roughness at each stand to the final stand of the tandem mill. It has been found that good brightness is obtained by setting average roughness Ra of the final roll to 0.15 μm or less. It is acceptable that the roll roughness Ra is preferably set between 0.15 μm and 0.05 μm. The roll roughness Ra should not be below 0.05 μm to avoid slippage between the roll and the steel sheet. Slippage causes an unstable rolling operation.

Additionally, when the surface roughness of the steel sheet before cold-rolling remains the same after completion of the cold rolling, the surface brightness of a product from the steel sheet is poor. Therefore, to obtain a steel sheet having excellent brightness characteristics, the concavities and convexities on the surface of the steel sheet before cold rolling should be a small value.

A non-lubricant preliminary treatment rolling may be performed before cold rolling. The preliminary treatment for the steel sheet may include hot rolling the steel sheet that has been annealed and pickled. It has been found that the surface roughness before cold rolling is not sufficiently reduced with a reduction of 5% or less. A reduction for the preliminary treatment rolling in excess of 5% is required.

In order to reduce fine seizure such as heat streaks during the non-lubricant preliminary treatment rolling, the surface of the work roll may be coated with a liquid lubricant to a thickness of 1 μm or less. The roughness on the surface of the steel sheet before cold rolling is not sufficiently reduced with a reduction of 5% or less. A reduction in excess of 5% is required. On the other hand, it has been recognized that to reliably prevent an occurrence of seizure, it is necessary that a reduction is maintained at a low level because seizure occur with a reduction in excess of 30%. Therefore, a reduction between a level of 30% and 5% is necessary. Preferably, preliminary treatment rolling is performed in a preliminary processing mill separately installed in front of the cold tandem mill.

EXAMPLE 1

SUS430 was used as a mother sheet as an example of a ferrite based stainless steel sheet. After a hot rolled steel sheet of SUS430 was annealed and pickled, it passed to a five stand cold rolling tandem mill having stands of rolls successively numbered 1 through 5. A roll barrel composed of WC based hard metal alloy containing 15% Ni and having Young's modulus of 50,000 kg/mm$^2$ was applied to stand NO. 4 and stand NO. 5. The roll necks for these stands were composed of a semi-high speed steel. A 5% Cr forged steel was applied to stands NO. 1 to NO. 3. The hot rolled steel sheet was cold-rolled from a starting thickness of 4.0 mm to an intermediate thickness of 1.3 mm.

For the purpose of a comparison, cold-rolling was performed using ordinary 5% Cr forged steel for all the stands of the cold-rolling tandem mill.

The cold-rolled steel sheet was finish-annealed, pickled and finally subjected to skin pass rolling at an elongation of 1%.

The surface brightness of the cold-rolled stainless sheets were measured in accordance with JIS Z8741 Brightness Measuring Method 5 (GS 20°). The results of measurements were classified such that a brightness 950 or more was classified as an extra A, a brightness of 800 to 950 was classified as A, a brightness of 600 to 800 was classified as B, a brightness of 400 to 600 was classified as C and a brightness of 400 or less was classified as D.

As is apparent from the results shown in Table 1, the cold-rolled stainless steel sheet produced in accordance with the method of the present invention exhibits excellent brightness characteristics as compared to the steel sheet produced in accordance with the conventional method.

TABLE 1

| | Type of Steel | Applied Stand | Roll Diameter (mm) | Material of Roll | Load per Unit Width (kgf/mm) | Entry Thickness and Delivery Thickness (mm) | Brightness of Finished Steel Strip Surface |
|---|---|---|---|---|---|---|---|
| | Cold Working Tandem Mill | | | | | | |
| Example of the Invention | SUS 430 | 1 | 530 | 5% Cr forged steel | 730 | 4.00/3.20 | A |
| | SUS 430 | 2 | 550 | 5% Cr forged steel | 750 | 3.20/2.56 | A |
| | SUS 430 | 3 | 560 | 5% Cr forged steel | 850 | 2.56/2.05 | A |
| | SUS 430 | 4 | 330 | Roll Barrel: | 630 | 2.05/1.64 | A |
| | SUS 430 | 5 | 360 | WC + Ni 15% | 510 | 1.64/1.30 | A |
| | | | | Roll neck: | | | |
| | | | | Semi-high speed | | | |
| Conventional Example | SUS 430 | 1 | 530 | 5% Cr forged steel | 730 | 4.00/3.20 | C |
| | SUS 430 | 2 | 550 | 5% Cr forged steel | 750 | 3.20/2.56 | C |
| | SUS 430 | 3 | 560 | 5% Cr forged steel | 850 | 2.56/2.05 | C |
| | SUS 430 | 4 | 330 | 5% Cr forged steel | 700 | 2.05/1.64 | C |
| | SUS 430 | 5 | 360 | 5% Cr forged steel | 560 | 1.64/1.30 | C |

EXAMPLE 2

SUS304 was used as a mother sheet as an example of an austenite based stainless steel sheet. A five stand cold rolling tandem mill was used to cold-roll the mother sheet. A work roll for a first stand of the tandem mill includes a roll core made of a cold working die steel and a WC alloy containing 5 wt % Ni and having Young's modulus of 60,000 kg/mm$^2$ fitted to an outer periphery of the roll core. A work roll at the final stand was dimensioned to have a diameter of 400 mm or less. The mother sheet was cold-rolled from a mother sheet thickness of 3.0 mm to a finish thickness of 0.98 mm.

As a comparative example, cold-rolling was performed using work rolls made of ordinary 5% Cr steel for all five stands of the tandem mill. The work roll at the final stand was dimensioned to have a diameter of 400 mm or less.

As a conventional example, work rolls made of ordinary 5% Cr forged steel were used for all five stands of the tandem mill. The work roll diameter at the final stand was 400 mm.

After completion of the cold rolling operation, each steel sheet was finish-annealed, pickled and then subjected to a skin pass rolling at an elongation of 1%, and thereafter, it was buff-polished by one pass by using an adhesive cloth #40. Subsequently, the surface brightness of the steels were examined. The surface brightness for each cold-rolled stainless steel sheet was evaluated in a similar manner, as described above in connection with Example 1.

As is apparent from the results shown in Table 2, the cold-rolled stainless steel sheet produced in accordance with the method of the present invention exhibits very excellent brightness characteristics as compared to the steel sheets produced in accordance with the comparative and conventional examples.

TABLE 2

| | Type of Steel | Thickness of mother sheet | Applied Stand | Material of Roll | Work Roll Diameter (mm) | Finished Thickness (mm) | Process After Cold Rolling | Brightness of Finished Steel Strip Surface |
|---|---|---|---|---|---|---|---|---|
| | | | Cold Working Tandem Mill | | | | | |
| Example of the Invention | SUS 304 | 3.0 mm | 1 | WC + Ni 5% *1 | 600 | 0.98 | Finish | A |
| | SUS 304 | 3.0 mm | 2 | 5% Cr steel | 580 | 0.98 | annealing, | A |
| | SUS 304 | 3.0 mm | 3 | 5% Cr steel | 570 | 0.98 | pickling + | A |
| | SUS 304 | 3.0 mm | 4 | 5% Cr steel | 610 | 0.98 | Finish | A |
| | SUS 304 | 3.0 mm | 5 | 5% Cr steel | 280 | 0.98 | skinpass | A |
| | | | | | | | rolling + | |
| | | | | | | | Buff | |
| | | | | | | | polishing | |
| Comparative Example | SUS 304 | 3.0 mm | 1 | 5% Cr steel | 550 | 0.98 | Finish | B |
| | SUS 304 | 3.0 mm | 2 | 5% Cr steel | 530 | 0.98 | annealing, | B |
| | SUS 304 | 3.0 mm | 3 | 5% Cr steel | 510 | 0.98 | pickling + | B |
| | SUS 304 | 3.0 mm | 4 | 5% Cr steel | 590 | 0.98 | Finish | B |
| | SUS 304 | 3.0 mm | 5 | 5% Cr steel | 300 | 0.98 | skinpass | B |
| | | | | | | | rolling + | |
| | | | | | | | Buff | |
| | | | | | | | polishing | |
| Conventional Example | SUS 304 | 3.0 mm | 1 | 5% Cr steel | 550 | 0.98 | Finish | D |
| | SUS 304 | 3.0 mm | 2 | 5% Cr steel | 530 | 0.98 | annealing, | D |
| | SUS 304 | 3.0 mm | 3 | 5% Cr steel | 510 | 0.98 | pickling + | D |

TABLE 2-continued

| Type of Steel | Thickness of mother sheet | Cold Working Tandem Mill: Applied Stand | Material of Roll | Work Roll Diameter (mm) | Finished Thickness (mm) | Process After Cold Rolling | Brightness of Finished Steel Strip Surface |
|---|---|---|---|---|---|---|---|
| SUS 304 | 3.0 mm | 4 | 5% Cr steel | 590 | 0.98 | Finish skinpass rolling + Buff polishing | D |
| SUS 304 | 3.0 mm | 5 | 5% Cr steel | 515 | 0.98 | | |

*1: Outer periphery is composed on WC + Ni (5%), while shaft core is composed of cold worked die steel (fitted roll)

SUS430 steel sheet was used as a mother sheet as an example of a ferrite based hot-rolled stainless steel sheet. It was annealed and pickled, and thereafter, cold-rolled in the five stand cold rolling tandem mill. In this example, an outer periphery of the work roll for stand NO. 5 is composed of a WC based hard metal alloy including 5% Co and having Young's modulus of 63,000 kg/mm$^2$. The outer periphery is fitted to a roll shaft core composed of a cold working die steel. The hot-rolled stainless sheet was cold-rolled from a thickness of 3.0 mm to 0.7 mm with a reduction of 30% at NO. 5 stand. Subsequently, after completion of the cold rolling operation, the stainless sheet was finish-annealed and pickled, and thereafter, subject to skin pass-rolling producing an elongation of 0.8%. The surface brightness of the stainless sheet was then examined.

As a comparative example, a work roll composed of WC based hard metal alloy containing 5 wt % of Ni was applied to stand NO. 5. The stainless sheet was cold rolled with a reduction of 21% in stand NO. 5. Thereafter, the steel sheet was finish-annealed and pickled and subject to skin pass-rolling producing an elongation of 0.8%. The surface brightness of the stainless sheet was then examined.

As a conventional example, cold rolling was also performed using work rolls made of ordinary 50% Cr forged steel. The work rolls were the same for all stands of the cold rolling tandem mill. Thereafter, the stainless sheet was finish-annealed, pickled and subject to skin pass-rolling at an elongation of 0.8%. The surface brightness of the stainless sheet was then examined. The surface brightness of the cold-rolled stainless sheets were evaluated in a similar manner, as described above in connection with Example 1. As is apparent from the results shown in Table 3, the cold-rolled stainless sheet produced in accordance with the method of the present invention exhibits very excellent brightness characteristics as compared to the steel sheets produced in accordance with the comparative and conventional examples.

TABLE 3

| | Type of Steel | Cold Working Tandem Mill: Applied Stand | Roll Diameter (mm) | Material of Roll | Entry Thickness and Delivery Thickness | Reduction (%) | Brightness of Finished Steel Strip Surface |
|---|---|---|---|---|---|---|---|
| Example of the Invention | SUS 430 | 1 | 530 | 5% Cr forged steel | 3.00/2.27 | 24.3 | A |
| | SUS 430 | 2 | 550 | | 2.27/1.73 | 23.8 | A |
| | SUS 430 | 3 | 560 | | 1.73/1.31 | 24.2 | A |
| | SUS 430 | 4 | 570 | | 1.31/1.00 | 23.7 | A |
| | SUS 430 | 5 | 280 | WC + Co 5% *1 | 1.00/0.70 | 30.0 | A |
| Comparative Example | SUS 430 | 1 | 530 | 5% Cr forged steel | 3.00/2.10 | 30.0 | B |
| | SUS 430 | 2 | 440 | | 2.10/1.58 | 24.8 | B |
| | SUS 430 | 3 | 560 | | 1.58/1.18 | 25.3 | B |
| | SUS 430 | 4 | 570 | | 1.18/0.89 | 24.6 | B |
| | SUS 430 | 5 | 280 | WC + Co 5% *1 | 0.89/0.70 | 21.3 | B |
| Conventional Example | SUS 430 | 1 | 530 | 5% Cr forged steel | 3.00/2.10 | 30.0 | D |
| | SUS 430 | 2 | 550 | | 2.10/1.58 | 24.8 | D |
| | SUS 430 | 3 | 560 | | 1.58/1.18 | 25.3 | D |
| | SUS 430 | 4 | 570 | | 1.18/0.89 | 24.6 | D |
| | SUS 430 | 5 | 280 | | 0.89/0.70 | 21.3 | D |

*1: Outer periphery is composed of WC + Co (5%), while shaft core is composed of cold worked die steel (fitted roll)

EXAMPLE 4

SUS304 steel sheet was used as a mother sheet as an example of an austenite based hot-rolled stainless steel sheet. The sheet was annealed, pickled, and subject to a preliminary treatment rolling at a reduction in excess of 5%. The work roll in the preliminary treatment rolling includes a surface coated with an aqueous lubricant to a thickness of 1 μm or less. Thereafter, an integral type work roll of a WC alloy containing 30% C and having Young's modulus of 43,000 kg/mm$^2$ was used for work rolls in stands NO. 3 to NO. 5 the five stand cold rolling tandem mill. The stainless sheet was cold-rolled from a thickness of 5.0 mm to a finished thickness of 2.3 mm.

As a comparative example, hot-rolled stainless sheet was annealed, pickled, and subject to a preliminary treatment rolling at a reduction of 5% or less. The surface of the work roll for the preliminary treatment rolling was coated with an aqueous based lubricant to a thickness of 1 μm or less. Subsequently, work rolls made of a WC alloy containing 30% C were used in stands NO. 3 to NO. 5 in the five stand cold rolling tandem mill.

As a conventional example, a hot-rolled stainless steel sheet was annealed and pickled. The steel sheet was then cold-rolled in the five stand cold rolling tandem mill. Each stand was equipped with work rolls made of ordinary 5% Cr forged steel.

Thereafter, the stainless sheet was finish annealed, pickled, and subject to a skin pass-rolling at an elongation of 0.8%. Subsequently, the sheeting buff polished the surface brightness of the cold-rolled stainless sheets were then examined. The surface brightness of the cold-rolled stainless sheets were evaluated in a similar manner, as described above in connection with Example 1.

As is apparent from the results shown in Table 4, the cold-rolled stainless sheet produced in accordance with the method of the present invention exhibits excellent brightness characteristics compared to the steel sheet produced in accordance with the comparative and conventional examples.

TABLE 4

| | | | Preliminary Treatment Rolling | | Cold Working Tandem Mill | | | | | | |
|---|---|---|---|---|---|---|---|---|---|---|---|
| | Type of Steel | Thickness of Steel Sheet | Lubrication *1 | Reduction (%) | Applied Stand | Diameter of Work Roll (mm) | Material of Roll | Reduction (%) | Thickness of Finished Products (mm) | Processes after Cold Rolling | Brightness Finished Steel Strip Surface |
| Example of the Invention | SUS 304 | 5.0 | 0.3 μm | 15 | 1 | 530 | 5% Cr forged steel | 13.8 | 2.3 | Finish annealing, pickling + Finish skinpass rolling + Buff polishing | A |
| | SUS 304 | 5.0 | 0.3 μm | 15 | 2 | 550 | 5% Cr forged steel | 13.9 | 2.3 | | A |
| | SUS 304 | 5.0 | 0.3 μm | 15 | 3 | 560 | WC + Co 30% | 13.8 | 2.3 | | A |
| | SUS 304 | 5.0 | 0.3 μm | 15 | 4 | 570 | (Integral roll) | 14.1 | 2.3 | | A |
| | SUS 304 | 5.0 | 0.3 μm | 15 | 5 | 300 | | 40.9 | 2.3 | | A |
| Comparative Example | SUS 304 | 5.0 | 2.0 μm | 15 | 1 | 530 | 5% Cr forged steel | 20.0 | 2.3 | Finish annealing, pickling + Finish skinpass rolling + Buff polishing | B |
| | SUS 304 | 5.0 | 2.0 μm | 15 | 2 | 550 | 5% Cr forged steel | 20.0 | 2.3 | | B |
| | SUS 304 | 5.0 | 2.0 μm | 15 | 3 | 560 | WC + Co | 19.9 | 2.3 | | B |
| | SUS 304 | 5.0 | 2.0 μm | 15 | 4 | 570 | (Integral roll) | 20.0 | 2.3 | | B |
| | SUS 304 | 5.0 | 2.0 μm | 15 | 5 | 300 | | 20.7 | 2.3 | | B |
| Conventional Example | SUS 304 | 5.0 | No preliminary treatment rolling was performed | | 1 | 530 | 5% Cr forged steel | 20.0 | 2.3 | Finish annealing, pickling + Finish skinpass rolling + Buff polishing | D |
| | SUS 304 | 5.0 | | | 2 | 550 | 5% Cr forged steel | 20.0 | 2.3 | | D |
| | SUS 304 | 5.0 | | | 3 | 560 | 5% Cr forged steel | 19.9 | 2.3 | | D |
| | SUS 304 | 5.0 | | | 4 | 570 | 5% Cr forged steel | 20.0 | 2.3 | | D |
| | SUS 304 | 5.0 | | | 5 | 300 | 5% Cr forged steel | 20.7 | 2.3 | | D |

While this invention has been described in conjunction with specific embodiments and examples thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A method of producing a stainless steel sheet having excellent brightness comprising:

cold rolling a stainless steel sheet in a tandem mill including a plurality of stands, wherein said plurality of stands includes a second stand and a final stand and a surface roughness of work rolls from the second stand to the final stand is successively reduced; and wherein a work roll at the final stand has a roughness Ra between 0.05 and 0.15 μm; and wherein at least one work roll in at least one stand has a Young's modulus of 25,000 to 70,000 kg/mm$^2$.

2. The method according to claim 1, wherein said at least one work roll comprises a tungsten carbide based hard metal alloy.

3. The method according to claim 1, wherein the tandem mill includes a final stand having a work roll with a diameter less than or equal to a diameter of a work roll in a previous stand, wherein said work roll in said final stand is dimensioned to have a diameter between 150 mm to 400 mm.

4. The method according to claim 1, wherein the cold rolling includes performing a cold rolling operation to have a roll-down rate of between 25% and 60% in a final stand of the tandem mill.

5. The method according to claim 1, wherein said at least one work roll comprises a plurality of work rolls.

6. The method according to claim 1, further comprising providing said at least one work roll in a plurality of stands.

7. The method according to claim 1, wherein the process produces a stainless steel sheet with a brightness of greater than or equal to 800 when measured in accordance with JIS z8741 Brightness Measuring Method 5 GS 20°.

8. A method of producing stainless steel sheet having excellent brightness, comprising the steps of:

performing a preliminary treatment rolling operation on a stainless steel sheet; and cold rolling said stainless steel sheet in a tandem mill including a plurality of stands, wherein said plurality of stands includes a second stand and a final stand and a surface roughness of work rolls from the second stand to the final stand is successively reduced; and wherein a work roll at the final stand has a roughness Ra between 0.05 and 0.15 μm; and wherein at least one work roll in at least one stand has a Young's modulus of 25,000 to 70,000 kg/mm$^2$.

9. The method according to claim 8, wherein said at least one work roll comprises a tungsten carbide based hard metal alloy.

10. The method according to claim 8, wherein the tandem mill includes a final stand having a work roll with a diameter less than or equal to a diameter of a work roll in a previous stand, wherein said work roll in said final stand is dimensioned to have a diameter between 150 mm to 400 mm.

11. The method according to claim 8, wherein the cold rolling includes performing a cold rolling operation to have a roll-down rate of between 25% and 60% in a final stand of the tandem mill.

12. The method according to claim 8, wherein said step of performing a preliminary treatment rolling operation includes performing the rolling operation with a roll-down rate of between 5% and 30%.

13. The method according to claim 12, wherein said step of performing a preliminary treatment rolling operation includes coating a surface of the work roll with a fluid lubricant having a thickness of 1 μm or less.

14. The method according to claim 8, wherein said at least one work roll comprises a plurality of work rolls.

15. The method according to claim 8, further comprising providing said at least one work roll having a Young's modulus of 25,000 to 70,000 kg/mm$^2$ in a plurality of stands.

16. The method according to claim 8, wherein the process produces a stainless steel sheet with a brightness greater than or equal to 800 when measured in accordance with JIS z8741 Brightness Measuring Method 5 GS 20°.

* * * * *